United States Patent [19]

Stephens

[11] 4,218,892

[45] Aug. 26, 1980

[54] LOW COST CRYOSTAT

[76] Inventor: Robert A. Frosch, Administrator of the National Aeronautics and Space Administration, with respect to an invention of James B. Stephens, La Crescenta, Calif.

[21] Appl. No.: 25,162

[22] Filed: Mar. 29, 1979

[51] Int. Cl.[3] ..... F25B 19/00

[52] U.S. Cl. ..... 62/514 R; 165/105

[58] Field of Search ..... 165/105; 62/514 R

[56] References Cited

U.S. PATENT DOCUMENTS

| | | | |
|---|---|---|---|
| 3,216,210 | 11/1965 | Klipping | 62/514 R |
| 3,358,472 | 12/1967 | Klipping | 62/514 R |
| 3,609,992 | 10/1971 | Cacheux | 62/514 R |
| 3,611,746 | 10/1971 | Marsing et al. | 62/514 R |
| 3,742,729 | 7/1973 | Zulliger | 62/514 R |
| 3,884,296 | 5/1975 | Basiulis | 165/105 |
| 3,894,403 | 7/1975 | Longsworth | 62/514 R |

*Primary Examiner*—Ronald C. Capossela

*Attorney, Agent, or Firm*—Monte F. Mott; John R. Manning; Wilfred Grifka

[57] ABSTRACT

An improved cryostat for use in a low or a substantially gravity-free environment adapted to cool an experiment through the use of helium II, or helium in its super fluid state. The cryostat is characterized by a plurality of interchangeable daughter dewars and helium supply or mother dewar having connected therewith a low pressure venting system for converting helium I contained therein to a super fluid state for use as a primary cryogen. Each daughter dewar is adapted to be removably mounted in mated relation on the mother dewar and is characterized by a support for an experiment package, a source of helium to be employed as a secondary cryogen, and a heat pipe suspended therefrom and adapted to be extended into the mother dewar for facilitating cooling of the secondary cryogen whereby a transfer of heat from the package to the primary cryogen, via the secondary cryogen, is accommodated as a film flow of helium II progresses from the heat pipe to the experiment dewar.

8 Claims, 6 Drawing Figures

LOW COST CRYOSTAT

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The invention generally relates to cryostats for use in conducting experiments, and more particularly to a low cost cryostat for facilitating a serial interfacing of experiments with a single cryostat in a substantially gravity-free environment, commonly referred to as a Zero-G environment, for the sake of convenience hereinafter simply referred to as a gravity-free environment.

As is fully understood, helium may exist as a gas, or in a normal liquid state, also referred to as helium I, as well as in a super fluid state, herein referred to as helium II, depending upon the pressure and temperature thereof. While the thermal conductivity of helium II makes its use potentially desirable in the field of cryogenics, from a practical standpoint, its lack of any capacity to store heat tends to severely penalize its use for this purpose.

2. Description of the Prior Art

As can be fully appreciated by those familiar with the problems encountered in conducting experiments at cryogenic temperatures in a gravity-free environment, the carrying out of conventional experiments tends to be relatively expensive, particularly in instances where helium is used as a coolant. The expense, at least in part, is a consequence of the complexity of systems required for maintaining experiments in a liquid helium environment. Moreover, it heretofore generally has been accepted that a changing of experiment packages, within a given cryostat, cannot readily be accomplished in a gravity-free environment such as is found aboard an operating spacecraft. Therefore, experiments cooled using liquid helium as a coolant frequently are returned to earth in tact, thus requiring that for each experiment to be performed, a new set-up must be fabricated before launch.

Because of the long recognized aforementioned inadequacies of the prior art devices, there currently exists a need for a cryostat through use of which a number of experiments can be performed in a gravity-free environment utilizing a common mother or helium supply dewar and a plurality of daughter or experiment dewars, so that a series of experiments easily and quickly can be interfaced with the helium supply dewar, all without requiring fabrication of a new set-up for each of the experiments.

During the course of a preliminary search conducted for the invention hereinafter more fully described, the following patents were discovered:

| | | |
|---|---|---|
| Fulton, Jr., et al | 3,004,394 | Oct. 17, 1961 |
| Latterner, et al | 3,168,080 | Feb. 2, 1965 |
| Byrd | 3,548,930 | Dec. 22, 1970 |
| Katz | 3,596,713 | Aug. 3, 1971 |
| Chu, et al | 3,609,991 | Oct. 5, 1971 |
| Sturm, et al | 3,688,838 | Sept. 5, 1972 |
| Beaussay, et al | 3,824,598 | July 16,1974 |
| Basiulis | 3,884,296 | May 20, 1975 |

While the patents discovered in the course of the search clearly indicate a use of numerous systems employing helium as a coolant, for performing cooling functions of a varied nature, none of the references discovered in the course of the search suggest a system which embodies the principles of the invention, hereinafter described with more particularity.

For example, United States Letters Pat. No. 3,004,394 discloses a helium heat rectifier which will conduct heat in a first direction when a temperature differential is established across the device, but will not conduct heat in opposite directions. United States Letters Pat. No. 3,884,296 discloses a heat pipe confining a cryogenic working fluid such as oxygen, liquid nitrogen and freon and is considered to be of interest. The remaining references were selected simply because they are believed to be of general interest.

It is, therefore, the general purpose of the instant invention to provide a low cost cryostat of a practical design which facilitates faster turn-around time, and generally tends to reduce the costs normally incurred in conducting experiments at low cryogenic temperatures in gravity-free environments.

OBJECTS AND SUMMARY OF THE INVENTION

It is an object of the instant invention to provide an improved, low cost cryostat.

It is another object to provide an improved cryostat which facilitates an assembly of experiment set-ups in gravity-free environments.

It is another object to provide a cryostat characterized by a slightly modified standard shipping helium supply dewar adapted to receive sequentially a series of experiment dewars.

Another object is to provide a cryostat which is particularly useful in connection with the carrying out of experiments requiring low cryogenic temperatures in a gravity-free environment.

These and other objects and advantages are achieved through the use of a cryostat characterized by a mother dewar comprising a container adapted to substantially confine therein a body of liquid helium, in its normal as well as its super fluid states, and a plurality of daughter dewars adapted to be removably mounted on the mother dewar and serially employed for carrying out experiments, as will become more readily apparent by reference to the following description and claims in light of the accompanying drawings.

DESCRIPTION OF THE PREFERRED EMBODIMENT

Figure 1:
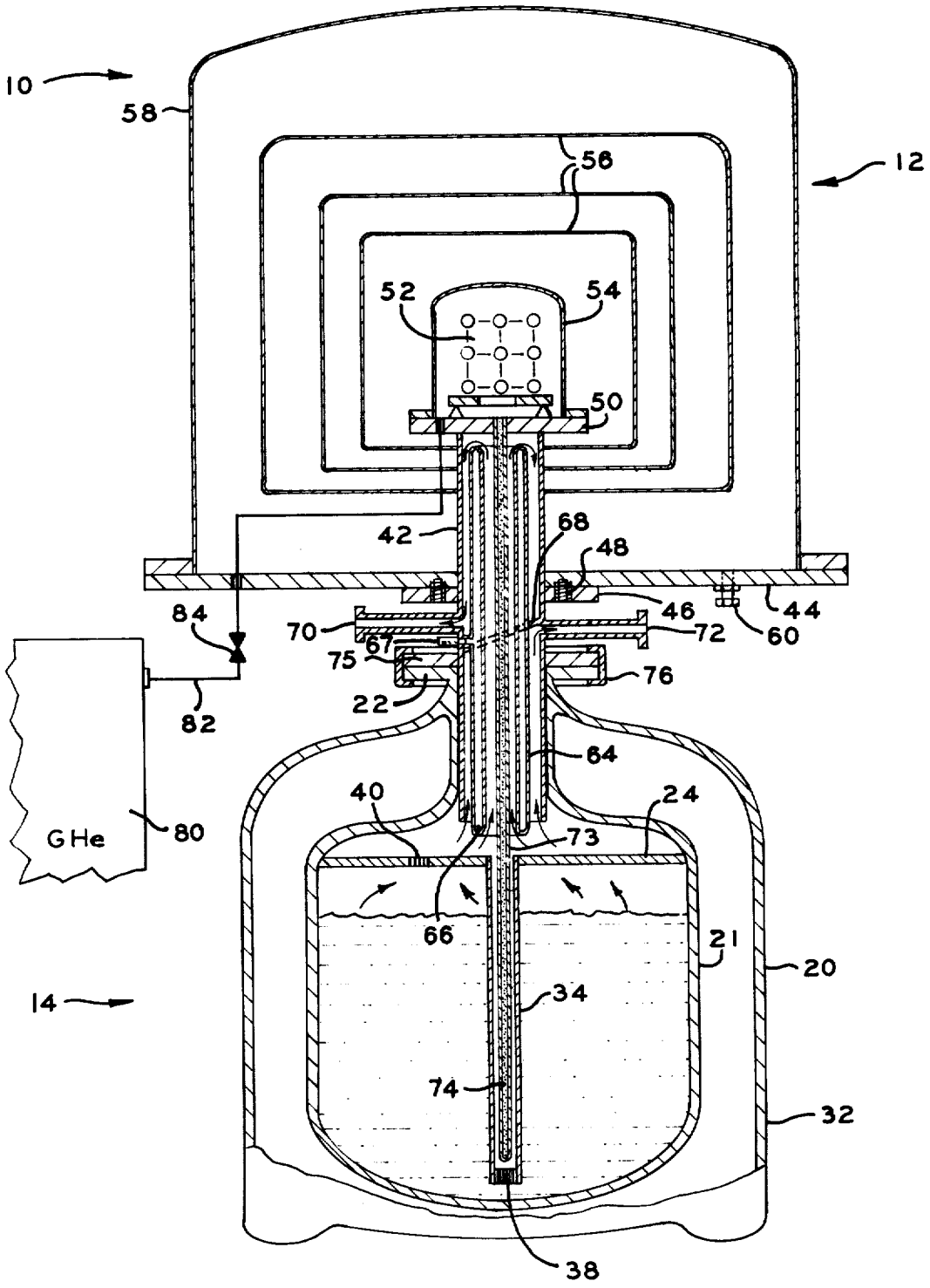
FIG. 1 is a vertically sectioned, fragmented view of an improved cryostat, which embodies the principles of the instant invention, depicted in a stabilized mode for a One-G environment.

Referring now to the drawings, with more particularity, wherein like reference characters designate like or corresponding parts throughout the several views, there is shown in FIG. 1 a cryostat, generally designated 10, embodying the principles of the instant invention.

As shown in FIG. 1, the cryostat 10 includes a daughter dewar 12, herein also referred to as an experiment dewar. The daughter dewar is mounted on a mother dewar, herein also referred to as a helium supply dewar 14, employing a thermal coupling stem, generally designated 16. In operation, the stem 16 serves to couple the dewar 12 with the helium supply dewar 14, as will hereinafter be more fully be discussed.

Figure 3:
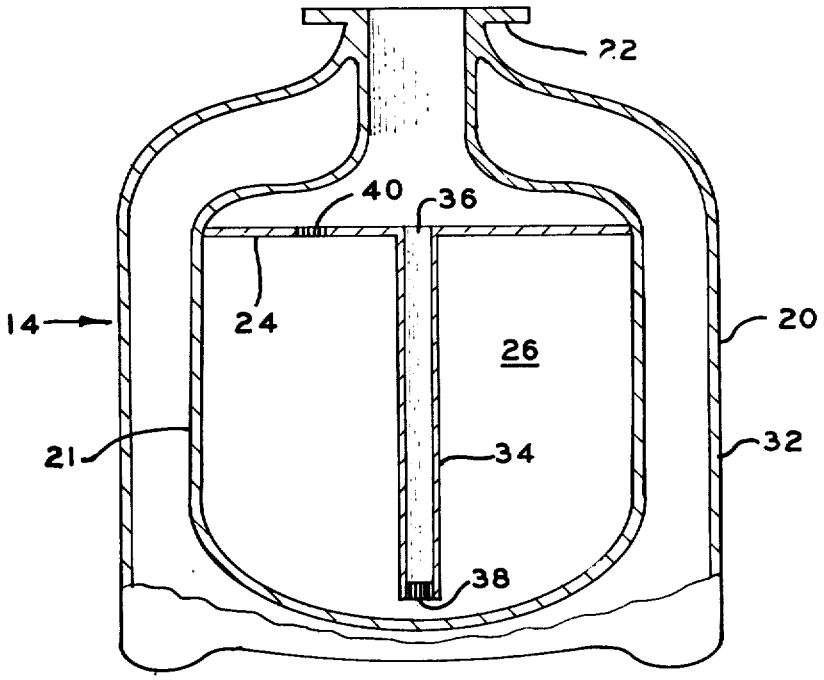
FIG. 3 is a vertically sectioned view of the helium supply or mother dewar provided for the cryostat.

The helium supply dewar 14, best shown in FIG. 3, comprises a standard shipping dewar including an outer vessel 20, and an inner vessel 21. The outer vessel is modified to include an enlarged external flange 22. The inner vessel 21 includes a plate 24 extended transversely across one end thereof to establish a cavity 26 provided for substantially confining helium in its super fluid state as well as in its normal state to be employed as a primary cryogen, or coolant, as will hereinafter become apparent. The inner vessel 21 is spaced inwardly from the wall, designated 32, defining the vessel 20, for thus establishing therebetween a space pumped-down in order to create a vacuum which serves as a layer of insulation for the vessel 21, as can be fully appreciated by those familiar with the handling of liquid helium.

Extended axially through the plate 24 is a thimbal 34. The thimbal 34 comprises a tube of a generally cylindrical configuration having an access opening 36, formed at the portion thereof nearest the plate 24, and a porous plug 38 which serves to close the end thereof opposite the opening 36. While the purpose of the thimbal 34 will hereinafter become more readily apparent, it is to be understood that the thimbal is extended into the cavity 26 and that the porosity of the plug 38 is such as to accommodate passage of helium II into the thimbal. Additionally, the plate 24 includes a porous plug 40 for purposes of accommodating evaporation during operation of the cryostat.

Figure 2:
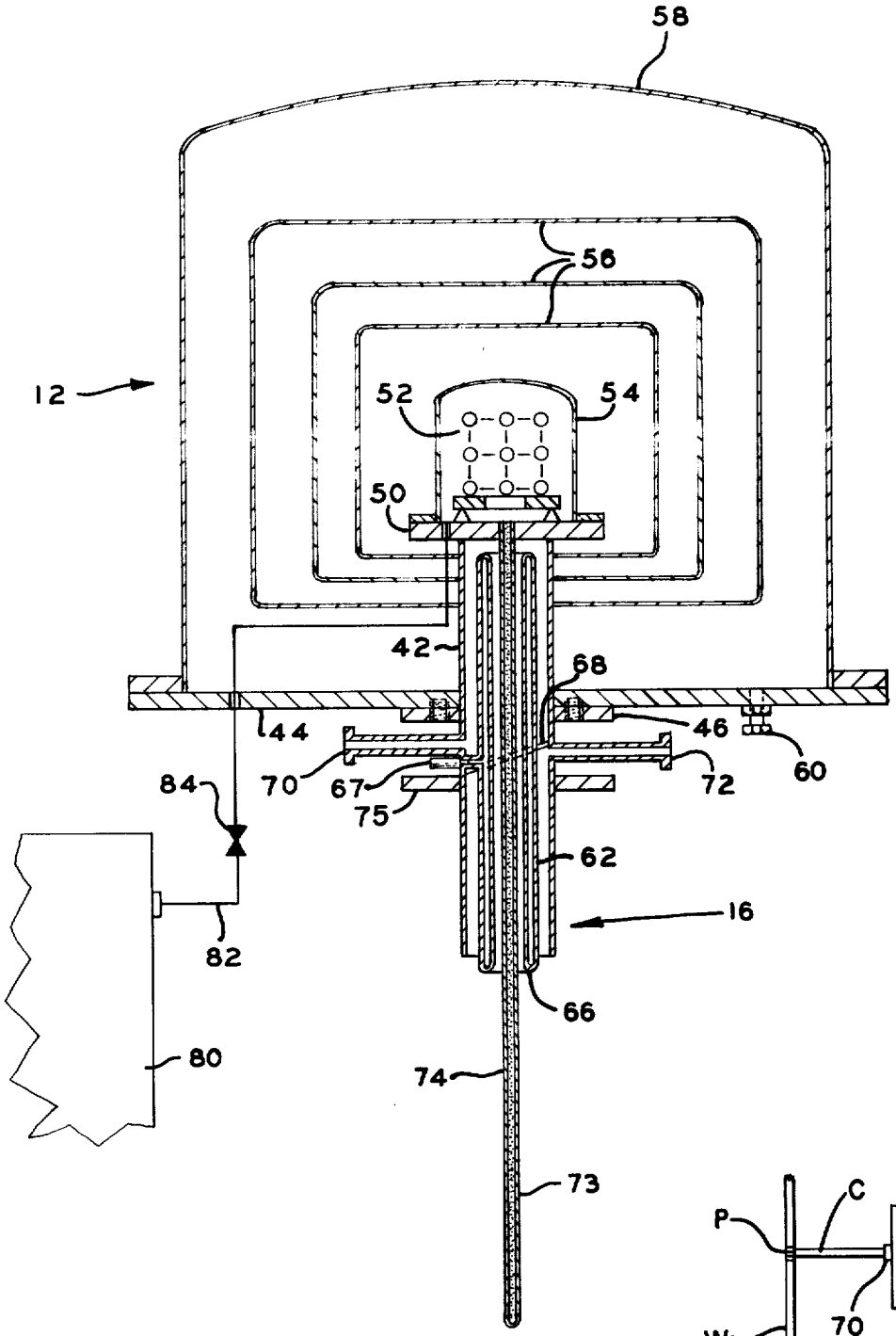
FIG. 2 is a vertically sectioned, fragmented view of an experiment or daughter dewar for the cryostat.

Referring now to FIG. 2, it can be seen that the experiment dewar 12 is mounted in supported relation on a neck 42 comprising a tube of a cylindrical configuration. The neck preferably is formed of titanium, or, as a practical matter, fiberglass, and is extended axially through a bore, not designated, formed in a base plate 44 provided for the experiment dewar 12. The plate 44, as shown, is coupled to the neck 42 through the use of a collar 46. The collar 46 is of an annular configuration and circumscribes the neck 42 and is rigidly affixed thereto by a weld or the like. As shown, the collar 46 is attached to the base plate 44 employing screw threaded fasteners 48, FIG. 1, of a suitable design.

Mounted on the neck 42 at its uppermost end there is an experiment support plate 50. This plate is of a generally planar configuration and serves to receive in supported relation an experiment package 52 enclosed in an experiment vessel, designated 54. It is to be understood that the package 52 is removably mounted on the support 50 in a suitable manner, the details of which form no part of the claimed invention.

Also mounted on the neck 42, and supported thereby, there is a plurality of mutually spaced, concentrically arranged radiation shields 56. These shields are encased within the experiment dewar 12 by the outermost wall thereof, designated 58, also supported by the plate 44. As a practical matter, the radiation shields 56 are formed from thin plate stock and are provided for protectively reflecting radiant thermal energy back toward the wall 58 for thus aiding in maintaining a relatively low temperature within the vessel 54. Additionally, thermal energy absorbed by the shields 56 is transferred to the neck 42 by conduction.

At this juncture, it is important to appreciate that the shields 56, and the experiment vessel 54 are not hermetically sealed so that a vacuum drawn-down in the experiment dewar 12 will pervade the entire dewar for further insulating the experiment package 52. In order to facilitate a drawing-down of a vacuum within the experiment dewar 12, a suitable fitting 60 is mounted on the base plate 44 and employed in a manner fully understood by those familiar with such devices.

Figure 4:
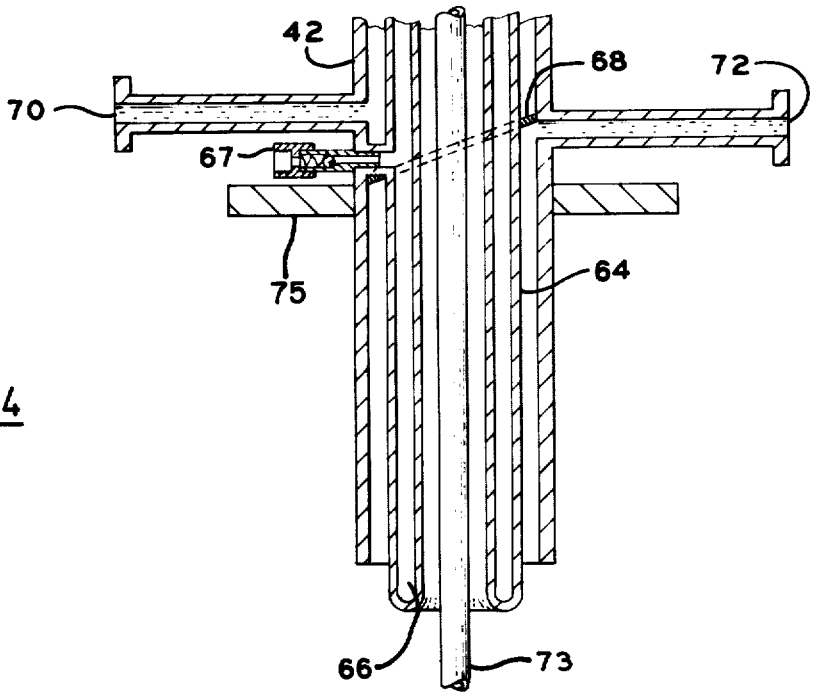
FIG. 4 is a fragmented, partially sectioned view, on an enlarged scale, of a thermal conductor employed in coupling the daughter dewar with the mother dewar.
Figure 5:
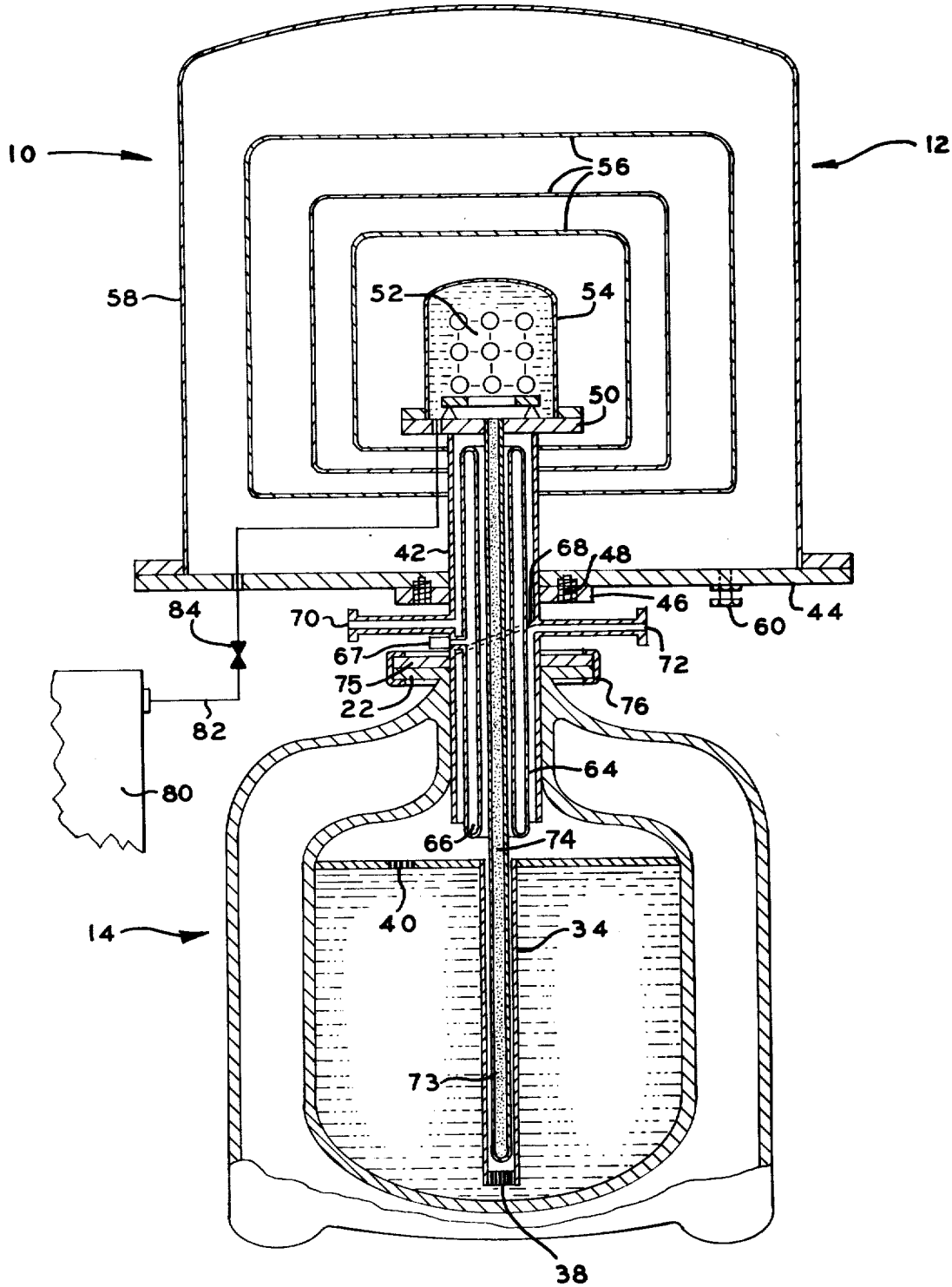
FIG. 5 is a vertically sectioned, fragmented view depicting in the dewar in a stabilized operative mode for a gravity-free or Zero-G environment.

Within the coupling stem 16, FIG. 2, there is provided a thermal shield 64. This shield is disposed in concentric relation with the neck 42 and comprises a tubular body having an internal chamber 66 of an annular cross sectional configuration. In practice, a vacuum is drawn-down in the chamber 66 for purposes of enhancing the insulating characteristics of the shield. As best illustrated in FIG. 4, a bore, not designated, is formed in the wall of the shield, while a fitting 67 is extended through the bore for facilitating a drawing-down of a vacuum within the internal chamber 66.

The shield 64 is supported within the neck 42 through the use of a support plate 68 of a substantially annular configuration. The plate 68 is received by the neck 42 and circumscribes the outermost surface of the shield 64. It is to be understood that the plate is connected to the shield at its inner periphery, and to the neck at its outer periphery, by suitable means, such as welds and the like, whereby the shield is supported in fixed concentric relation within the neck 44.

Figure 6:
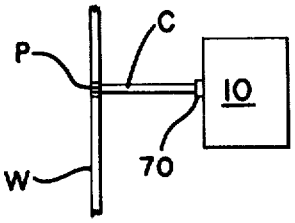
FIG. 6 is a schematic view depicting one manner in which the cryostat is connected with a discharge orifice formed in the wall of a spacecraft.

It also should be noted that the neck 42 is provided with a pair of radially extended vents, designated 70 and 72. Through these vents the interior of the neck 42 is permitted to communicate with ambient atmosphere. As a practical matter, and as schematically depicted in FIG. 6, the vent 70 connects the interior of the neck tube 42, above the plate 68, in communication with the exterior surface of a spacecraft wall, designated W, through a tubular conduit C which terminates in a porous plug P closing a discharge port formed in the wall. The vent 72, on the other hand, communicates with the interior of the neck beneath the plate 68 and may be vented overboard, if so desired. However, it is to be understood that gaseous helium having a propensity to advance along the outer surface of the shield 64 is intercepted and vented from the cryostat 10 via the vent 72, for purposes which will hereinafter become apparent. Of course, gaseous helium which is permitted to progress along the internal surface of the shield 64 passes through the neck and is expelled therefrom through the vent 70.

As shown, extended axially through the shield 64 there is a heat pipe 73. The heat pipe is of an elongated tubular configuration and is rigidly affixed to and suspended from the support 50. Preferably, as shown, the heat pipe is closed at one and communicates with the vessel 54 at the other. The purpose of the heat pipe simply is to provide a surface along which helium, in either of its liquid states is permitted to flow, during the operation of the cryostat 10, as will hereinafter become more readily apparent.

Within the heat pipe 73 there is a wick 74, the purpose of which is to provide a path for liquid helium under G-loads so that liquid helium may be encouraged to traverse the heat pipe along its length. The wick comprises a body of suitable material such as, for example, compacted jewelers rouge or the like.

It also is noted that the neck 42 also is provided with a collar 75 of an annular configuration disposed in circumscribing relation therewith and rigidly affixed thereto. The purpose of the collar 75 is to mate in face-to-face relation with the upper surface of the flange 22 of the supply dewar 14, whereby an hermetic seal readily may be established therebetween, as the experiment dewar 12 is mated in operative relation with the helium supply dewar 14. While any suitable means is employed for connecting the collar 75 to the flange 22, a suitable quick release coupler 76 serves quite satisfactorily for this purpose. While not shown, it is to be understood that the coupler 76 is provided with an over-center locking lever, of conventional design, for securing the coupler 76.

It is important to note that to the interior of the vessel 54 there is connected a chamber 80 comprising a source of helium gas to be employed as a secondary cryogen. Preferably, the chamber 80 is connected to the vessel through a capillary tube 82 which accommodates a transfer of helium therebetween. Within the tube 82 there is provided a flow control valve 84, the purpose of which is to control a supply of helium to the experiment package 54 for reasons which will hereinafter be more fully understood. It is sufficient, at this juncture, to note that the chamber 80, the interior of the dewar 12 and the heat 73 are interconnected in a closed circuit and that helium is supplied thereto by the chamber 80. It is to be further understood, however, that where so desired, the heat pipe 73 may be provided with a suitable port disposed in communicating relation with the chamber 26 of the mother dewar 14 thus permitting the chamber 80 to be eliminated. However, this arrangement is in many instances less than totally satisfactory simply because control over transfer of helium to the dewar 12 is difficult to achieve.

OPERATION

It is believed that in view of the foregoing description of the cryostat 10, the operation thereof readily is apparent. However, in the interest of completeness the operation of the described embodiment will at this point briefly be reviewed.

Initially, the mother or helium supply dewar 14 is filled with normal helium or helium I through its neck, employing a suitable device, not shown, which forms no part of the instant invention.

Preferably, a plurality of daughter dewars 12 have been assembled in a suitable manner, each being provided with a selected experiment package 52. The details of the experiment packages 52, of course, form no part of the instant invention. However, it will be appreciated that to each of the daughter dewars 12 there is connected a chamber 80 filled with helium maintained under suitable pressures, such as, for example, 1600 psi. In practice, a vacuum is drawn-down in each of the dewars 12 and the valve 84 is in its closed configuration. Thus communication between the interior of the daughter dewar and the chamber is interrupted. A daughter dewar 12 is now mated with the mother dewar 14 and the vent 70 is connected to a porous plug P of a port communicating with the exterior surface of the craft within which the cryostat is installed.

It will, at this point, be apparent that as shown in FIG. 1, the daughter and mother dewars 12 and 14, respectively, are mated simply by inserting the heat pipe 73 into the thimbal 34 and the collar 75 coupled to the flange 22, employing the coupler 76 to form therebetween an hermetic seal.

At this juncture, the cryostat 10 assumes a stabilized One-G mode of operation in which helium I escapes through the plug 40 to the upper surface of the plate 24, at which point evaporation occurs. Helium gas now escapes from the vessel 21 via the vents 76 and 72. Of course, as the helium I escapes the plug 40 and undergoes evaporation, the resultant gas progresses along a path extended through and about the shield 64 prior to its escape from the cryostat via the vents 70 and 72, and thus an initial cool-down of the shield 64 and of the heat pipe 73 is achieved. This cool-down operation continues so long as a venting of the gas is accommodated.

During the launch phase of the spacecraft in which the cryostat 10 is transported to a gravity-free environment, conversion of the helium I, or normal helium, to a super fluid state occurs as a consequence of the craft being caused to ascend to a low pressure region of the atmosphere and beyond. The conversion results from the propensity of the liquid helium, acting in a Zero-G or gravity-free environment, to "wet" all of the interconnecting surfaces which serve to connect the vessel 21 to the plug P located at the exterior surface of the craft. As can be appreciated, the exterior surfaces of the craft are exposed to the pressures of the low pressure region and heat is dissipated as helium II progresses through the plug P and evaporates at the external surface of the craft. As a result of this phenomenon, heat is conducted away from the vessel 21 and the temperature of the helium I therein is lowered sufficiently to cause a conversion of the helium I to helium II.

Of course, it will be appreciated that the exterior surface of the heat pipe 73 also is wetted by the helium I and subsequently the helium II as it enters the thimbal 34 via the porous plug 38. As a consequence, temperatures within the heat pipe 73 are reduced as heat is transferred through the wall thereof.

Assuming that the valve 84 is now opened, relatively warm helium gas under pressure is permitted to escape from the chamber 80, via the capillary tube 82. Because of the propensity of relatively warm helium to flow toward relatively colder bodies, helium having escaped from the chamber 80 enters the experiment package 52 and then egresses therefrom down the heat pipe, toward the relatively cold body of helium II. As the gas thus is caused to enter the mother dewar 14, from the daughter dewar 12, condensation of the gas with an attendant pressure drop occurs, whereupon the gas is converted to helium I. As is well known, helium I also has an affinity for cooler surfaces and bodies, consequently, helium I continues to move toward the mother dewar to be converted to helium II as the temperature thereof is greatly reduced in response to a transfer of heat therefrom through the wall of the heat pipe 73. Since helium II, as is well known, has an affinity for warmer surfaces, a counter flow of helium I and II is in fact established along the inner surfaces of the heat pipe 73 until such time as the helium I within the heat pipe is converted to helium II.

As the helium I is converted to helium II within the heat pipe, the resultant helium II, or super fluid helium, advances toward the warmer experiment package until a film of super fluid helium is caused to coat the internal surfaces of the vessel 54, and thus cool the experiment package by conducting the heat away from the experiment to the surface of the craft, via the helium II contained in the vessel 21 of the mother dewar.

It is noted that because of an ultimate stabilization of pressure within the capillary tube 82, super fluid helium cannot progress through the tube 82 to the chamber 80. Thus the chamber 80 remains relatively warm and charged with gas.

In the event it becomes desirable to replace the daughter dewar 12 in space, or in a gravity-free environment, the aforementioned daughter dewar is released and the heat pipe attached thereto extracted from the mother dewar 12. Of course, as the release is effected and the heat pipe 73 is extracted from the thimbal 34, a low pressure condition is established in the thimbal 34 whereupon the helium II contained therein rapidly is converted to a gas and spillage of helium II thus is prevented. Another daughter dewar 12 now is mated with the motor and the aforedescribed cycle repeated.

As a matter of interest, while not illustrated, it should be apparent that a ground check of the system can easily be achieved simply by orienting the cryostat 10 on its side in order to permit helium in its various states to advance laterally and thus avoid the impairing effects of gravity.

In view of the foregoing it should readily be apparent that the instant invention provides a practical solution to many of the problems heretofore confronting those engaged in performing experiments at cryogenic temperatures in a gravity-free environment.

What is claimed is:

1. An improved cryostat for use aboard a spacecraft in a gravity-free environment comprising:

A. a mother dewar having an inner vessel confining a primary cryogen in a liquid state, a tubular thimbal extended thereinto, and means for cooling said primary cryogen at low pressures of celestial space including a vent connected with a porous plug communicating with an external surface of the spacecraft; and B. a plurality of serially useable daughter dewars, each having an experiment package mounted therein and confining a secondary cryogen for cooling the experiment package and including heat pipe means for transferring heat from the secondary cryogen to the primary cryogen comprising a tubular body having an elongated chamber extended the length thereof connected in communication with the experiment vessel and adapted to be telescopically received by said thimbal in communication with said primary cryogen.

2. An improved cryostat comprising:

A. a helium supply dewar adapted to confine a body of super fluid helium;

B. an experiment dewar removably mounted on said helium supply dewar adapted to confine an experiment package;

C. a thermal conductor comprising a heat pipe for conducting heat from said experiment package;

D. an experiment mounting plate disposed within said experiment dewar and connected to said thermal conductor adapted to receive said experiment package in supported relation, said thermal conductor being extended between said dewars for conducting film flow of super fluid helium toward said experiment package; and E. means for inhibiting a discharge of super fluid helium from said helium supply dewar including a ported plate seated in the supply dewar having at least one porous plug for initiating a conversion of super fluid helium to gaseous helium as the helium egresses from the supply dewar.

3. A cryostat as defined in claim 2 further comprising a tubular receptacle for said heat pipe extending into said helium supply dewar including an opening defined at one end for accommodating insertion of said tube and a porous closure disposed at the opposite end thereof for aiding in the flow of helium II from said supply dewar into contact with the external surfaces of said heat pipe.

4. A cryostat as defined in claim 3 further comprising a vacuum insulated jacket extended between said dewars and concentrically related to said heat pipe for shielding the heat pipe from thermal radiation.

5. A cryostat as defined in claim 4 further comprising means for converting helium I to helium II including means for venting said supply dewar to low pressure.

6. In an improved cryostat for use in Zero-G environment and adapted to cool an experiment package through a use of helium II, the improvement comprising:

A. a helium supply dewar having an internal plate adapted substantially to confine helium II within the dewar and characterized by a tubular thimble suspended therefrom and adapted to be immersed in a bath of helium II confined within the dewar, and means including a plug for venting helium I from the supply dewar;

B. an experiment dewar including a support adapted to receive an experiment package in supported relation therewith;

C. means for charging the experiment dewar with helium gas; and

D. heat pipe means communicating with said experiment dewar for delivering helium II to the experiment package characterized by a tube received within said thimble, connected to said support, and filled with a wick for conducting helium I from the experiment dewar toward said thimble, wherein the temperature of helium I is reduced to that of helium II confined within the supply dewar, and for conducting helium II toward said support, away from said thimble.

7. An improved cryostat as defined in claim 6 further comprising a radiation shield disposed within said experiment dewar for shielding an experiment package received by said support from thermal radiation.

8. An improved cryostat as defined in claim 7 further comprising a vacuum insulated jacket extended between said dewars and concentrically related to said tube for shielding the tube from thermal radiation.

* * * * *